US009115452B2

(12) United States Patent
Carr et al.

(10) Patent No.: US 9,115,452 B2
(45) Date of Patent: Aug. 25, 2015

(54) LAUNDRY TREATING APPLIANCE IMPELLER

(71) Applicant: Whirlpool Corporation, Benton Harbor, MI (US)

(72) Inventors: David W. Carr, Saint Joseph, MI (US); Joseph L. Moulton, Benton Harbor, MI (US); Dale E. Mueller, Benton Harbor, MI (US); Jon D. Strait, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 408 days.

(21) Appl. No.: 13/646,762

(22) Filed: Oct. 8, 2012

(65) Prior Publication Data

US 2014/0096568 A1 Apr. 10, 2014

(51) Int. Cl.

| | |
|---|---|
| ***D06F 13/00*** | (2006.01) |
| ***D06F 17/10*** | (2006.01) |
| ***D06F 23/04*** | (2006.01) |
| ***D06F 13/02*** | (2006.01) |

(52) U.S. Cl.
CPC ..... *D06F 13/02* (2013.01); *D06F 17/10* (2013.01); *D06F 23/04* (2013.01)

(58) Field of Classification Search
CPC ..... D06F 13/02; D06F 23/04; D06F 17/10
USPC ..... 68/131, 133, 134, 17 A
See application file for complete search history.

(56) References Cited

U.S. PATENT DOCUMENTS

| | | | | |
|---|---|---|---|---|
| 2,836,993 | A | | 6/1958 | Johnson et al. |
| 3,027,742 | A | | 4/1962 | Nowicki |
| 3,278,037 | A | | 10/1966 | Stelli et al. |
| 3,648,486 | A | | 3/1972 | Rosinski, Jr. et al. |
| 4,018,067 | A | | 4/1977 | Vona, Jr. et al. |
| 4,048,820 | A | * | 9/1977 | Pielemeier ..... 68/133 |
| 4,068,503 | A | * | 1/1978 | Platt ..... 68/133 |
| 4,127,015 | A | * | 11/1978 | Platt et al. ..... 68/133 |
| 4,129,018 | A | | 12/1978 | Platt |
| 4,137,737 | A | * | 2/1979 | Robandt et al. ..... 68/134 |
| 4,338,802 | A | * | 7/1982 | Ohmann et al. ..... 68/18 FA |
| 4,357,812 | A | * | 11/1982 | Braga et al. ..... 68/18 D |
| 4,520,638 | A | | 6/1985 | Brenner |
| 4,693,095 | A | | 9/1987 | Burk et al. |
| 4,787,220 | A | | 11/1988 | Noh |
| D300,969 | S | | 5/1989 | Bergeson |
| 4,920,770 | A | * | 5/1990 | Dooley et al. ..... 68/133 |
| 5,113,542 | A | * | 5/1992 | Pastryk et al. ..... 8/158 |
| 5,231,857 | A | | 8/1993 | Rew et al. |
| 5,440,903 | A | | 8/1995 | Kropf et al. |
| 5,916,275 | A | | 6/1999 | Chung |
| 6,212,722 | B1 | * | 4/2001 | Pinkowski et al. ..... 8/158 |
| 6,227,014 | B1 | | 5/2001 | Euler et al. |
| 7,757,522 | B2 | | 7/2010 | Pinkowski et al. |

(Continued)

FOREIGN PATENT DOCUMENTS

| | | | |
|---|---|---|---|
| GB | 1153856 | | 5/1969 |
| JP | 6319890 | A | 11/1994 |
| WO | 9313257 | A1 | 7/1993 |

*Primary Examiner* — Joseph L Perrin

(57) ABSTRACT

A laundry treating appliance may include a drum and an impeller. The impeller may have a raised center, a bottom plate, a transition region between the bottom plate and the raised center, a center post extending upward from the raised center, and a plurality of radial protrusions extending along the raised center, the bottom plate, and the transition region.

20 Claims, 7 Drawing Sheets

(56) References Cited

U.S. PATENT DOCUMENTS

2005/0039497 A1* 2/2005 Sundell et al. ..... 68/133
2007/0044520 A1* 3/2007 Kopyrin et al. ..... 68/131
2007/0062224 A1* 3/2007 La Belle et al. ..... 68/3 R
2007/0101772 A1* 5/2007 Duncan et al. ..... 68/3 R
2008/0017221 A1* 1/2008 Fife et al. ..... 134/18
2009/0293554 A1* 12/2009 Hettinger et al. ..... 68/133
2011/0030425 A1* 2/2011 Kim et al. ..... 68/132

* cited by examiner

LAUNDRY TREATING APPLIANCE IMPELLER

BACKGROUND

Laundry treating appliances typically include a clothes mover, such as an agitator or impeller, that imparts movement to the laundry load, whether indirectly through movement of the water, as with an agitator, or by direct contact between the laundry load and the clothes mover, such as for an impeller. When the clothes mover is an impeller, the treating of the laundry may be accomplished with less water because the amount of water needed to impart movement to the laundry load is less than that required for use with an agitator. However, distribution of the laundry load above the impeller may affect the movement of laundry and, thus, treating of the laundry load.

BRIEF SUMMARY

A laundry treating appliance configured to treat a laundry load according to a cycle of operation with a low level of treating liquid according to one embodiment of the invention may comprise a drum at least partially defining a treating chamber and having an open top and a longitudinal axis and an impeller mounted within the drum for reciprocal rotation about an axis generally coincident with the longitudinal axis of the drum. The impeller may include a raised center, a bottom plate located below the raised center and extending radially outwardly from the raised center and terminating in an outer periphery, a transition region between the bottom plate and the raised center, a center post extending upward from the raised center, and a plurality of radial protrusions extending along the raised center, the bottom plate, and the transition region, each protrusion having an upper section projecting generally perpendicular from the raised center and the transition region, and a lower section projecting upward from the bottom plate, with the lower section increasing in width toward the outer periphery. The protrusions and the bottom plate may be configured such that during the cycle of operation, when the level of the treating liquid does not exceed the height of the bottom plate, the reciprocal rotation of the impeller generates a frictional interaction between the laundry items and the protrusions to drag the laundry in contact with the protrusions radially inward toward the raised center and induce an inverse toroidal movement of the laundry.

DETAILED DESCRIPTION

Figure 1:
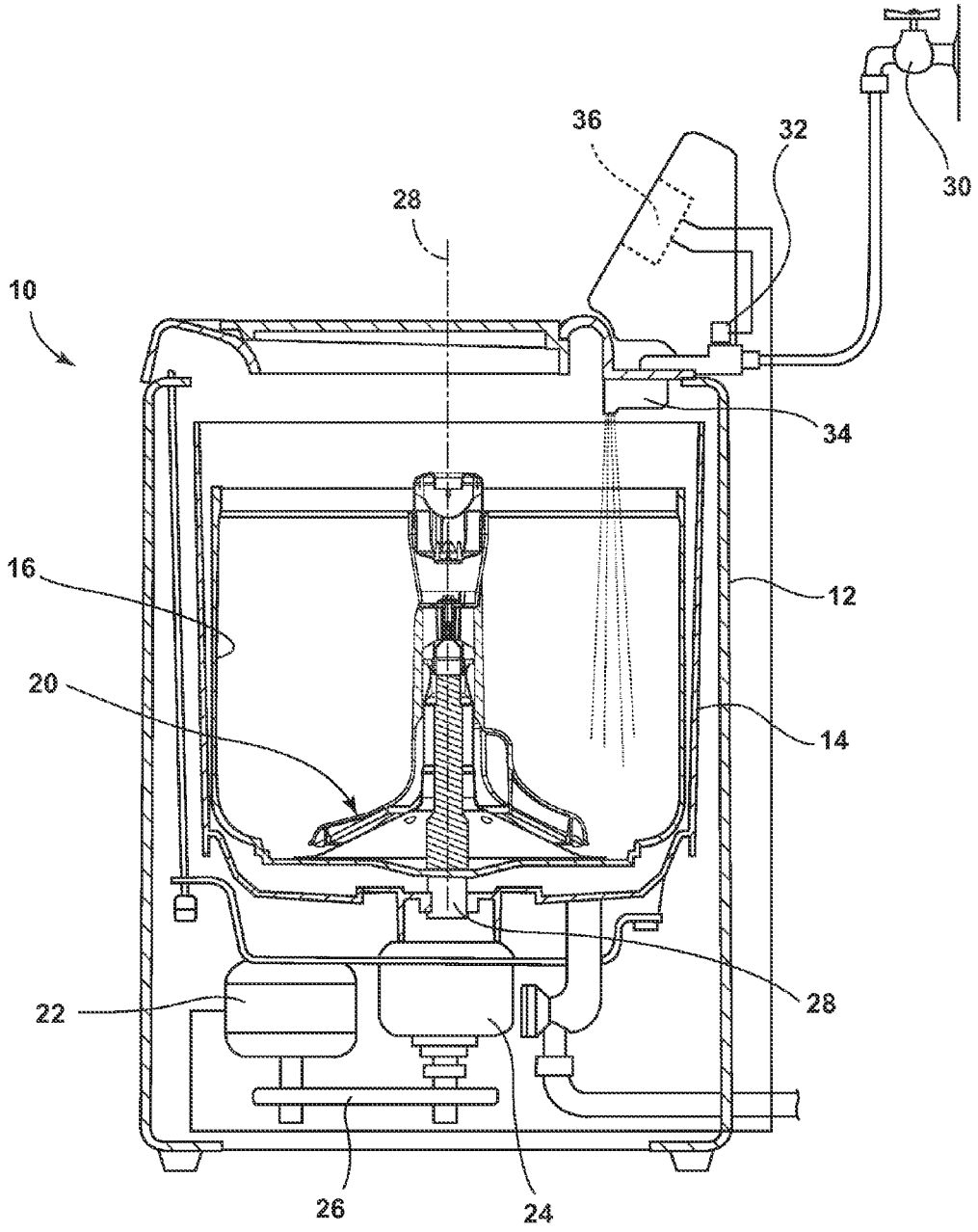
FIG. 1 is a schematic sectional view of a fabric treating appliance in the form of a washing machine having an impeller according to one embodiment of the invention.

Automatic clothes washers may typically comprise a perforated basket or drum for holding a laundry load, which may include garments, sheets, towels, and other fabric items, and an imperforate tub containing a wash liquid comprising water or a mixture of water and detergent. A clothes mover may be coaxially mounted in the bottom of the drum and adapted for angular oscillation in order to agitate the laundry load. In one configuration, the drum, the clothes mover, and the tub may be oriented about a vertical axis.

Traditionally, a vertical axis clothes mover may be configured as an impeller or an agitator. The impeller is typically a low-profile base element having a circular periphery, with protrusions extending from the base element. The agitator typically has a base, which may be in combination with an auger that extends along the vertical axis approximately the height of the tub.

It is generally understood that a deep fill wash cycle, typically associated with an agitator, refers to a cloth to water ratio that, when combined with the action of the clothes mover, produces fluid motion which significantly aids in the motion of the clothes even if the actual water level in the machine is not near the top of the wash basket. The garments are considered suspended in the free fluid, or submerged, when there is sufficient fluid power to directly result in movement of the garments. The combination of the agitator contacting the laundry, the water moving through the laundry, and the relative contact between the laundry items imparts mechanical energy to the laundry for cleaning. The agitator can impart a significant mechanical force to the laundry, which is tempered with the water from the deep fill as most of the mechanical energy from the motion of the agitator goes to moving the water.

Likewise, a low fill wash cycle, also called a low water wash cycle and typically associated with an impeller, generally refers to a cloth to water ratio that, when combined with the action of the clothes mover, produces insufficient fluid motion to directly result in cloth motion regardless of the direction of fluid motion. In fact, the resulting cloth motion may still be present even if very little free fluid is present. In this process, a garment is not considered to be suspended or submerged in the free fluid even if the actual water level is near the top of the drum or near the top of the clothes load. The mechanical energy for cleaning the laundry in the low water wash comes from the interaction between the fabric items, and the fabric-on-fabric interaction tends to be less harsh on the fabric compared to the manner in which mechanical energy is imparted to the laundry in deep fill wash cycles. Additionally, because the low water wash cycle does not rely on the motion of the fluid and suspension of the garments in the fluid, washing machines with an impeller and corresponding low water wash cycles use less water and are more energy efficient than washing machines with an agitator and corresponding deep fill wash cycles.

In a vertical axis clothes washer with a deep fill wash cycle where the clothes are completely submerged, reciprocal movement of an agitator moves the garments along a toroidal, or donut-shaped, path extending radially inwardly toward the center of the drum, downwardly along the vertical axis, radially outwardly toward the outer wall of the drum, and upwardly along the perimeter of the drum where they repeat the cycle. One full cycle along this path is commonly referred to as a "rollover."

In a low water cycle, such as where the clothes are wetted but not submerged, the movement of the clothes by reciprocating the impeller moves the garments in an opposite direction than that of the agitator with a deep fill in what has been termed an "inverse toroidal rollover." The inverse toroidal rollover typically moves the laundry load along a path extending radially outwardly toward the outer wall of the drum, downwardly along the perimeter of the drum, radially inwardly toward the center of the drum, and upwardly along the vertical axis where they repeat the cycle.

The present invention is directed to an impeller for use with a low water cycle in a laundry treating appliance. FIG. 1 is a schematic view of a laundry treating appliance according to a first embodiment of the invention. The laundry treating appliance may be any appliance that performs a cycle of operation to clean or otherwise treat items placed therein, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine.

The laundry treating appliance of FIG. 1 is illustrated as a washing machine 10, which may include a structural support system comprising a cabinet 12 which defines a housing within which a laundry holding system resides. The cabinet 12 may be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention.

The illustrated exemplary washing machine 10 may include a watertight tub 14 installed in the cabinet 12. A perforated drum 16 may be mounted in the tub 14 for rotation about a central, vertical axis of rotation 18 extending through the center of a vertical axis clothes mover in the form of an impeller 20, which will be described in further detail below. A drive motor 22 operating a transmission 24 through a drive belt 26 may be utilized to rotate the drum 16 and oscillate the impeller 20. The impeller 20 may be positioned above the floor of the drum 16 and rotated by a drive shaft 28 extending through an opening in the floor of the drum 16. The illustrated drive system for the drum 16 and the impeller 20 is provided for exemplary purposes only and is not limited to that shown in the drawings and described above; the particular drive system is not germane to the invention. The washing machine 10 may be fluidly connected to a water supply 30 through a valve assembly 32 which may be operated to selectively deliver water to the tub 14 through an outlet 34 that may be positioned at one side of the tub 14. The illustrated water supply system for the washing machine 10 is provided for exemplary purposes only and is not limited to that shown in the drawings and described above; the particular water supply system is not germane to the invention. A control panel 36 enables the operator to control the operation of the washing machine 10.

Figure 2:
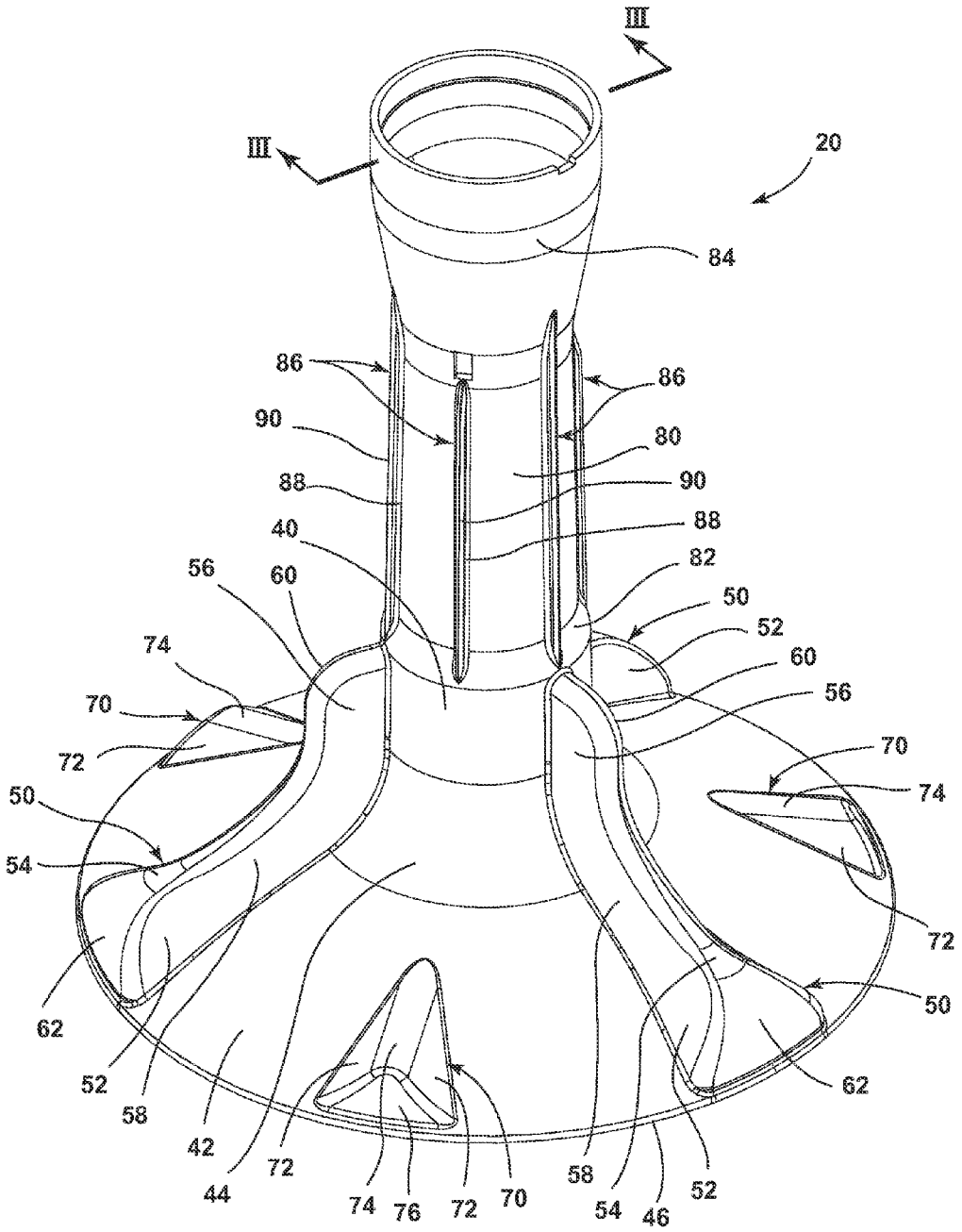
FIG. 2 is a perspective view of the impeller from FIG. 1 according to an embodiment of the invention.

Referring now to FIG. 2, which is a perspective view of the impeller 20 from FIG. 1, the impeller 20 may include a generally cylindrical raised center 40, a skirt-like bottom plate 42, and a transition region 44 between the raised center 40 and the bottom plate 42. As seen in section in FIG. 3, which is a sectional view taken along line III-III of FIG. 2, the transition region 44 may have an arcuate contour as illustrated, or any other suitable configuration, to transition the impeller 20 from the generally vertical wall of the raised center 40 to the downwardly angled wall of the bottom plate 42, which terminates at a generally circular outer periphery 46.

Figure 4:
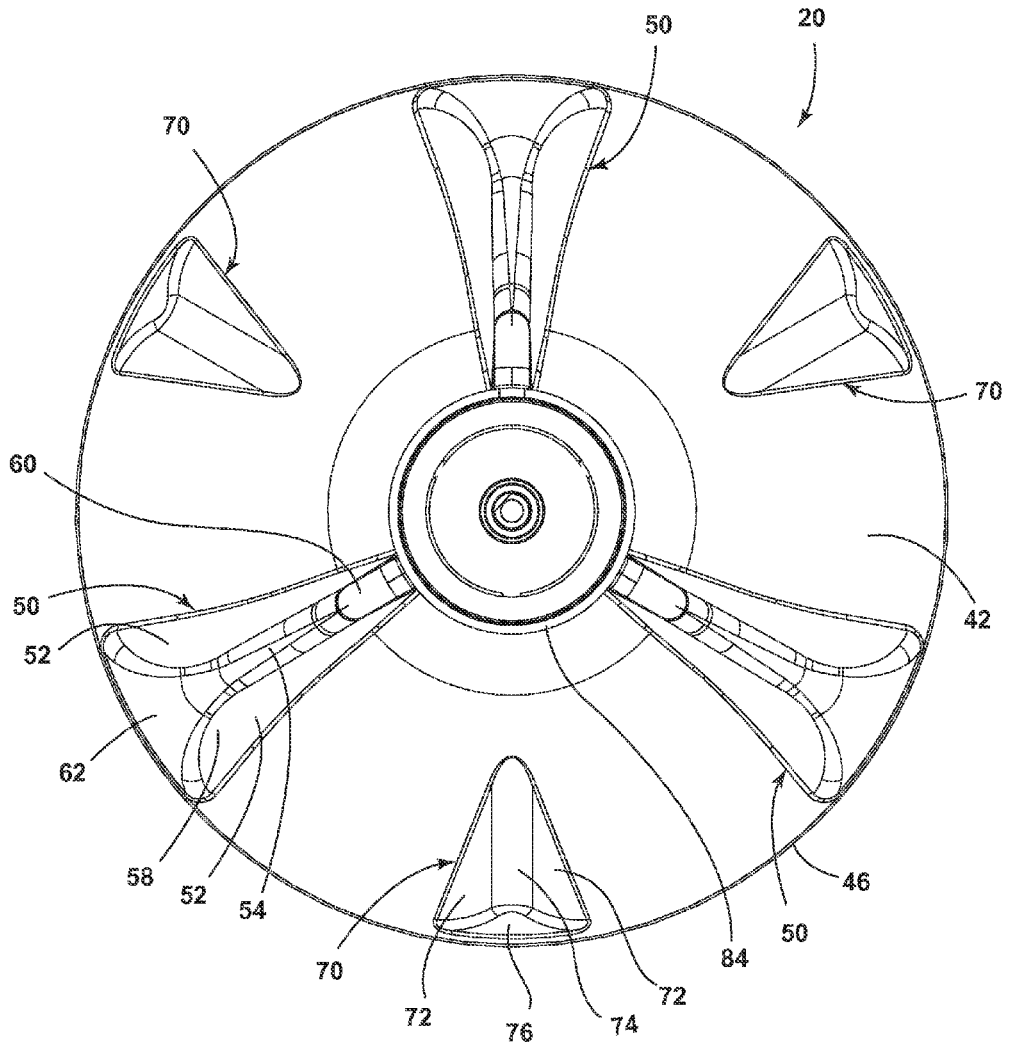
FIG. 4 is a top view of the impeller of FIG. 2.

Referring again to FIG. 2, the impeller 20 may further include a plurality of protrusions 50 extending radially from the raised center 40, the transition region 44, and the bottom plate 42. In particular, each of the protrusions 50 may be formed by a pair of opposing side walls 52 that meet at their upper ends to form an upper surface 54. The upper surface 54 defines the profile of the protrusions 50, which may be divided into an upper section 56 and a lower section 58. The upper section 56 projects in a generally perpendicular outward direction from the raised center 40 and the transition region 44, while the lower section 58, which may be integral and continuous with the upper section 56, projects generally upward from the bottom plate 42. At the upper section 56, the upper surface 54 transitions from a generally horizontal to a generally vertical orientation at a shoulder 60. Along the lower section 58, the upper surface 54 extends generally parallel to the bottom plate 42 and curves down to form a front wall 62 near the outer periphery 46. Moving along the radial extension of the upper surface 54 from the transition region 44, the upper surface 54 gradually widens at the portion parallel to the bottom plate 42 and then rapidly widens when the upper surface 54 curves downward to form the front wall 62. When viewing the impeller 20 from above, as in FIG. 4, which is a top view of the impeller 20, the protrusions 50 have a generally triangular configuration, with one of the corners of the triangle being located at the raised center 40 and the others positioned along the outer periphery 46. The protrusions 50 may have any suitable configuration and are not intended to be limited to those described above and shown in the illustrations Referring again to FIG. 2, in addition to the protrusions 50, the impeller 20 may include secondary protrusions 70. The term "secondary" is employed solely to differentiate the secondary protrusions 70 from the protrusions 50 and is not intended to attribute any characteristics to the secondary protrusions 70. The secondary protrusions 70 may be positioned between adjacent protrusions 50, such as a configuration where one of the secondary protrusions 70 is located between adjacent protrusions 50 equidistant from each of the adjacent protrusions 50. The secondary protrusions 70 may be formed by a pair of opposing side walls 72 that meet at their upper edges to define an upper surface in the form of a ridge 74. A front wall 76 having a generally triangular configuration may join the front edges of the side walls 72 and the ridge 74 and extend along the outer periphery 46. When viewing the impeller 20 from above, as in FIG. 4, the secondary protrusions 70 also have a generally triangular configuration, with one of the corners of the triangle being located on the bottom plate 42 and the others positioned along the outer periphery 46. The secondary protrusions 70 may have any suitable configuration and are not intended to be limited to those described above and shown in the illustrations.

The front walls 62, 76 of the protrusions 50 and the secondary protrusions 70 may be spaced a distance from the outer periphery 46, as illustrated in the figures, or, alternatively, may be coincident with the outer periphery 46. When the front walls 62, 76 are spaced from the outer periphery 46, the spacing may be any suitable distance.

Referring again to FIG. 2, the impeller 20 may further include a center post 80 extending upward from the raised center 40. The center post 80 may have any suitable configuration and is illustrated by example in the figures as generally cylindrical with a constant diameter. In the illustrated embodiment, the outer diameter of the center post 80 is smaller than that of the raised center 40 such that a step 82 may be formed between the center post 80 and the raised center 40. The step 82 may be gradual and arcuate, as illustrated, or may be more severe, such as a right angle. Any suitable step configuration is within the scope of the invention, as is a center post having a diameter equal to or greater than that of the raised center 40. Optionally, the center post 80 may terminate at its upper end at a flared section 84 that may be adapted to hold a treating agent dispenser (see FIG. 5), such as a commonly known fabric softener dispenser. The flared section 84 may be flared as shown in the figures or may have another type of configuration adapted to hold a treating agent dispenser. Alternatively, the upper end of the center post 80 may be shaped similarly to the rest of the center post 80, such as by having a constant diameter, and may not hold any type of treating agent dispenser.

Figure 3:
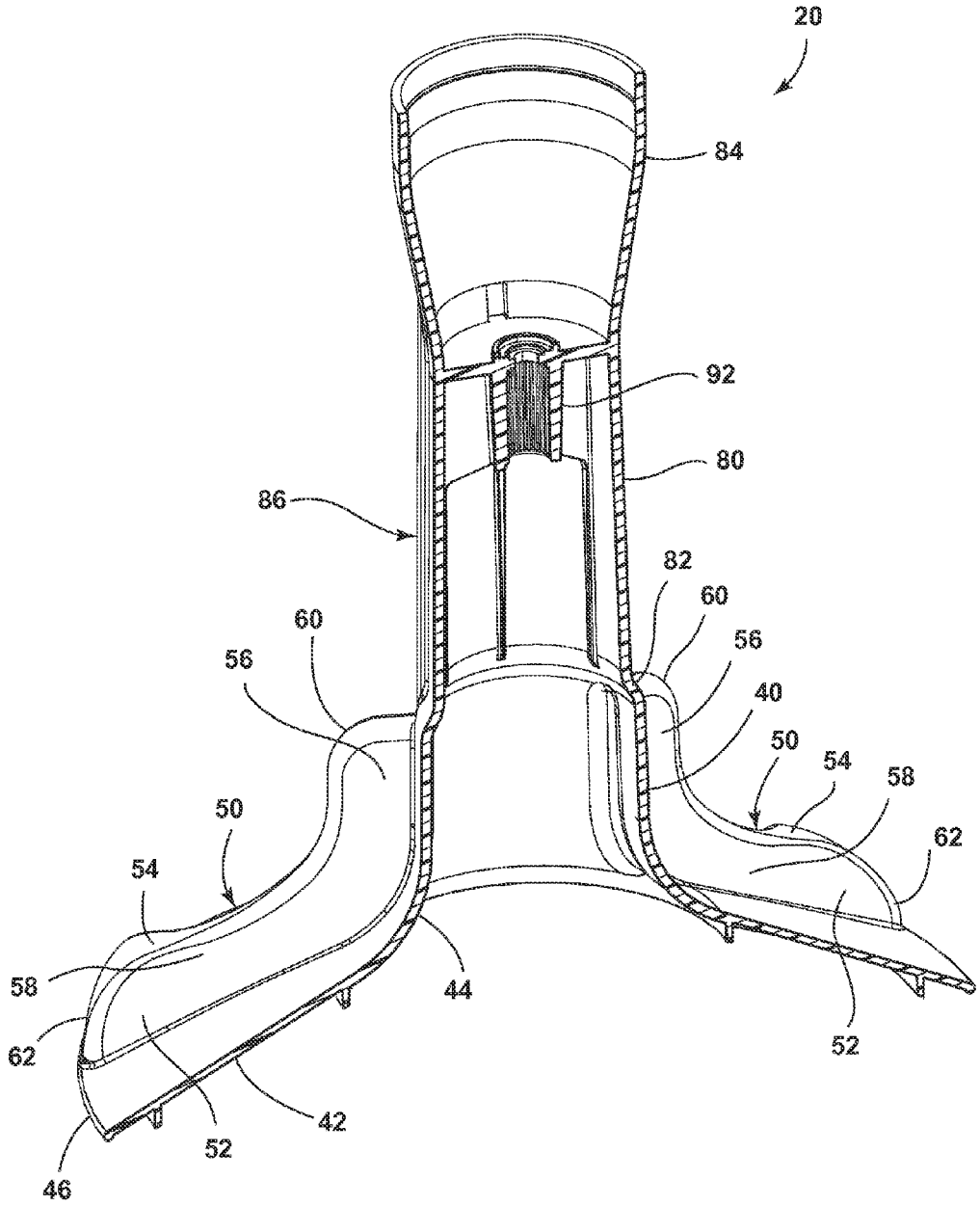
FIG. 3 is a sectional view of the impeller taken along line III-III of FIG. 2.

As another option, the center post 80 may include one or more vanes 86 extending radially from the center post 80. The vanes 86 may be connected to the center post 80 at a root 88 and terminate at an outer edge 90. While the vanes 86 may have any suitable configuration, the vanes 86 in the illustrated embodiment are circumferentially spaced and extend longitudinally along the center post 80 with a straight, vertical outer edge 90. At least some of the vanes 86 may be longitudinally aligned with the protrusions 50, if desired. The radial extent of the illustrated vanes 86 may be such that the outer edge 90 is coincident with the outer diameter of the raised center 40. Further, the vanes 86 may have any desired height and are shown as having a height greater than or equal to the constant diameter portion of the center post 80. As shown in FIG. 3, the center post 80 may further include an internal drive shaft coupler 92 configured to mate with the drive shaft 28 for rotating the impeller 20.

Figure 5:
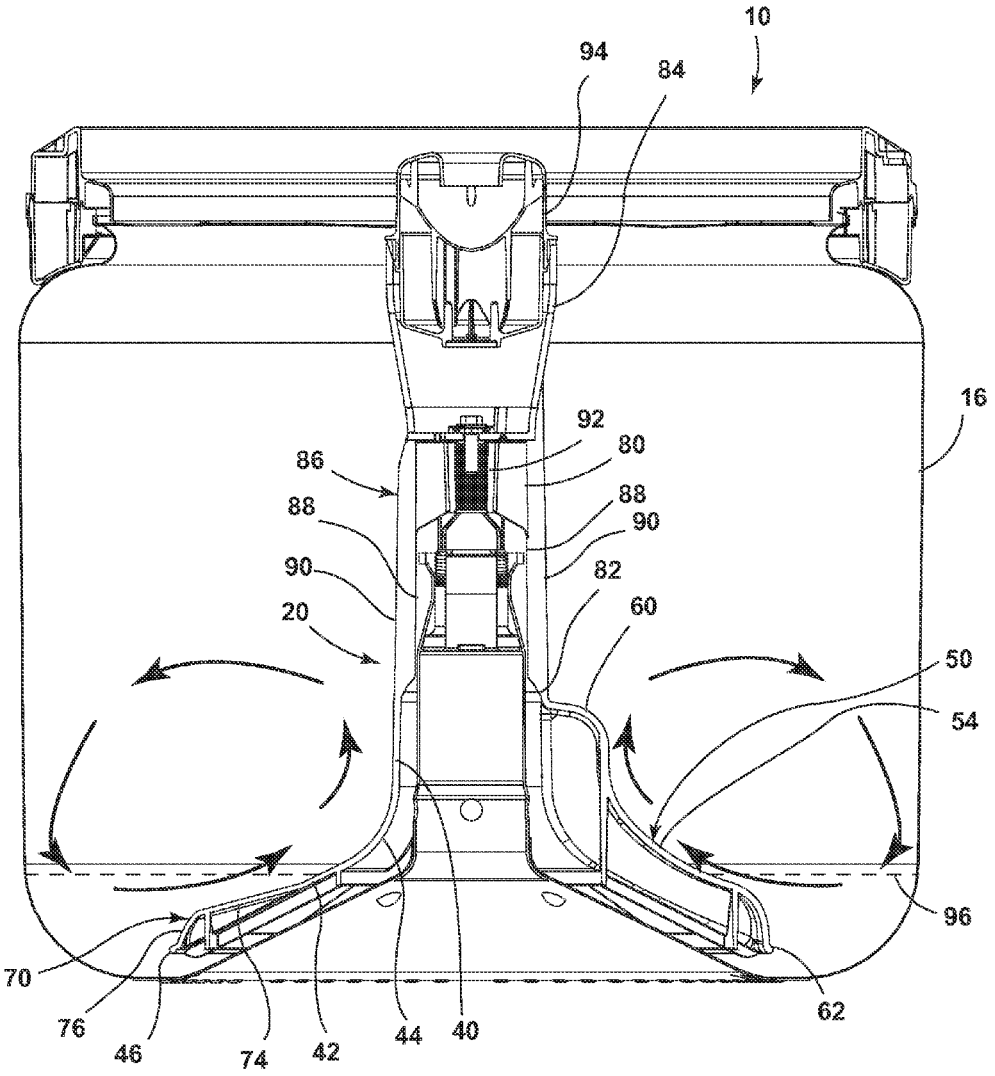
FIG. 5 is a sectional view of the impeller of FIG. 2 in the drum of the washing machine according to an embodiment of the invention.

Referring now to FIG. 5, which is a sectional view of the impeller 20 in the drum 16 of the washing machine 10 with a treating agent dispenser 94 in the flared section 84 of the impeller 20, the impeller 20 may be sized such that when it is mounted inside the drum 16, the outer periphery 46 is spaced from the side wall of the drum 16. The particular distance from the outer periphery 46 to the side wall of the drum 16 may be determined empirically to obtain a desired movement of the laundry load. Additionally, the impeller 20 may be proportioned such that the raised center 40, the transition region 44, and the bottom plate 42 have a combined height that is about one-third of the total height of the impeller 20, which corresponds to the center post 80 having a height of about two-thirds of the total height of the impeller 20. These exemplary proportions are provided for illustration and are not intended to limit the invention.

During operation of the washing machine 10 with the impeller 20, the treating liquid, such as water combined with a treating agent and hereinafter referred to as water, may be provided to the tub 14 and the drum 16, resulting in a water level suitable for a desired treating cycle of operation. For a cycle of operation with a low level of water, which is typically employed with clothes movers in the form of impellers, the water may be supplied to the drum 16 up to a maximum water level 96 that does not exceed the height of the bottom plate 42. The maximum water level 96 for a low water wash may differ from that shown in FIG. 5 depending on the configuration of the washing machine 10, the impeller 20, and the size of the laundry load. As described above, a low-level wash involves movement of the clothes by reciprocating the impeller 20. Reciprocating rotation of the impeller 20 moves the laundry load in the inverse toroidal rollover manner, as indicated by the arrows in FIG. 5. In particular, the reciprocal rotation of the impeller 20 generates a frictional interaction between the items in the laundry load and the protrusions 50, and this interaction drags the laundry items that are in contact with the protrusions 50 radially inward toward the raised center 40 to induce the inverse toroidal movement of the laundry.

Typically, when a laundry load is placed in a drum having a low-profile impeller, the laundry items naturally form multiple, generally horizontal layers, and each laundry item tends to spread out into a thin layer as it is placed in the drum 16. This produces a load that is interlayered with the layers extending over the center of the drum 16 and the impeller, especially when the laundry load includes large items, such as sheets, blankets, and towels. Laundry items spread out to cover the center of the impeller impede the inverse toroidal rollover necessary for proper treatment of the laundry load. However, the center post 80 of the impeller 20 prevents placement and migration of laundry items over the center of the impeller 20. When a user loads the laundry into the drum 16, the user must place the laundry items between the center post 80 and the side wall of the drum 16. Further, during operation, the laundry items moved radially inward along the bottom plate 42 must move upward when reaching the raised center 40 and the center post 80 and cannot migrate over the center of the impeller 20. Therefore, the combination of the impeller protrusions 50 and the center post 80 effects the desired inverse toroidal rollover of the laundry load.

Figure 6:
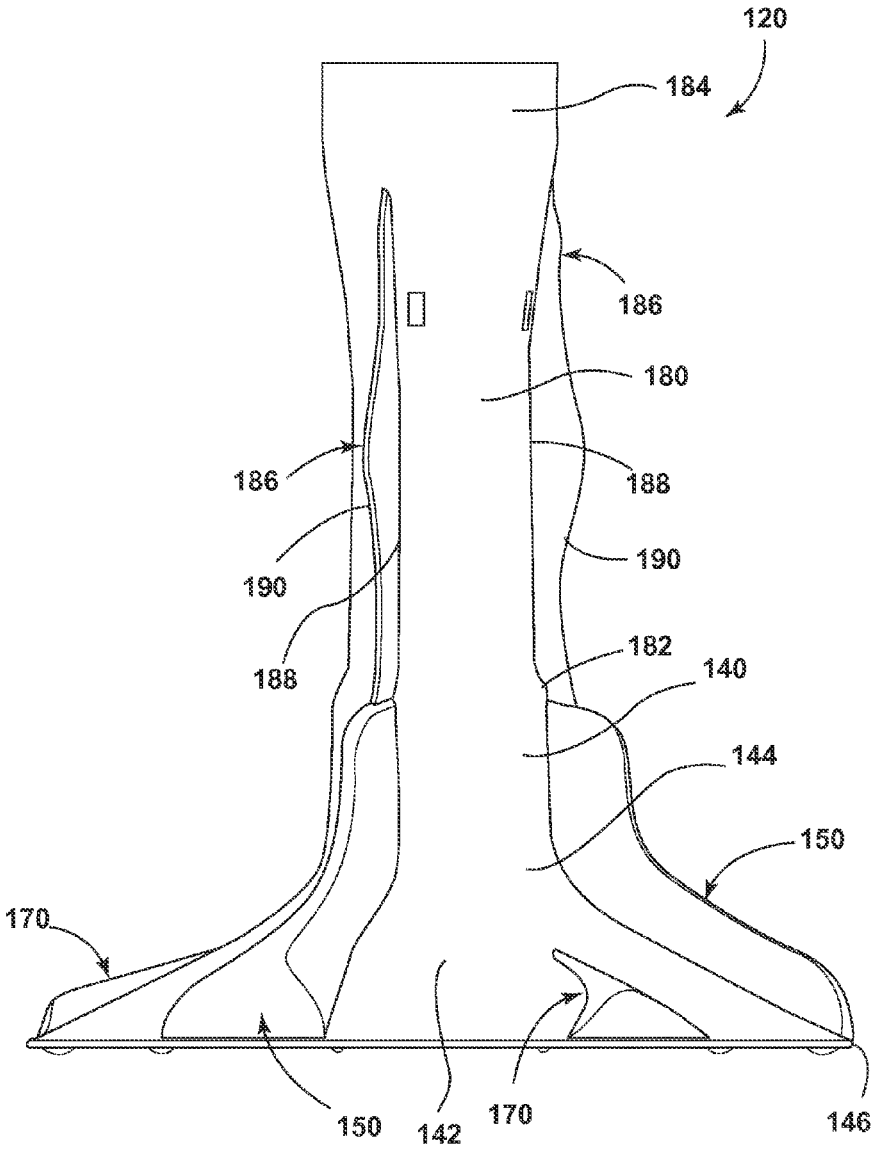
FIG. 6 is a side view of an impeller according to second embodiment of the invention.

As mentioned above, the vanes 86 may have any suitable configuration, and another embodiment of an impeller 120 having alternative vanes 186 is illustrated in FIG. 6, which is a side view of the alternative embodiment impeller 120. Items similar to those of the first embodiment impeller 20 of FIGS. 1-5 are identified with the same reference numeral bearing a leading "1." The alternative impeller 120 is substantially the same as the impeller 20, except that the outer edge 190 of the vanes 186 has a wavy or curved configuration, and the vanes 186 extend into the flared section 184 of the center post 180.

Figure 7:
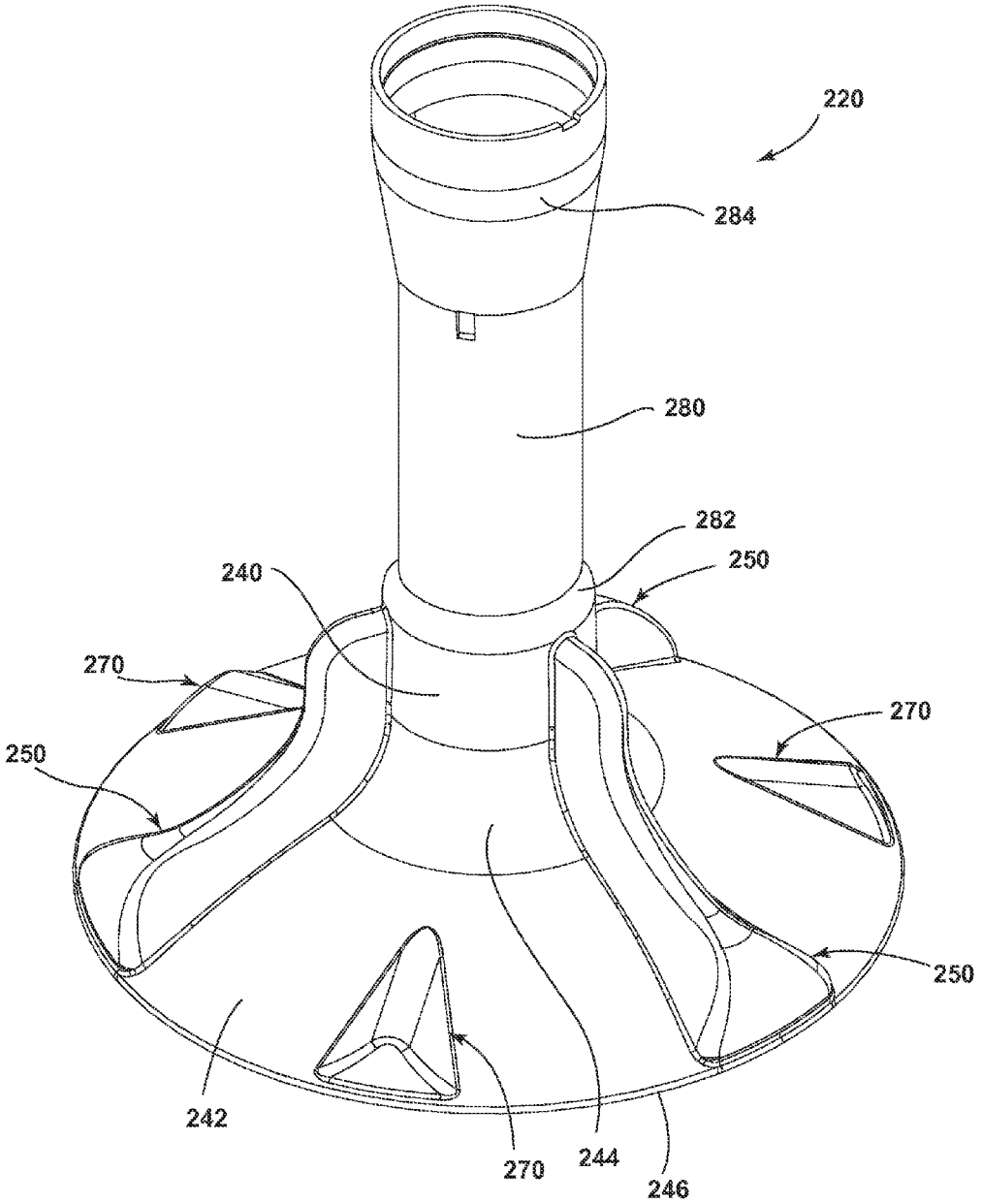
FIG. 7 is a perspective view of an impeller according to a third embodiment of the invention.

Further, the center post 80 need not have any of the vanes 86, as demonstrated by another embodiment of an impeller 220 depicted in FIG. 7, which is a perspective view of the alternative embodiment impeller 220. Items similar to those of the first embodiment impeller 20 of FIGS. 1-5 are identified with the same reference numeral bearing a leading "2." The alternative impeller 220 is substantially the same as the impeller 20, except that center post 280 lacks vanes.

While the invention has been specifically described in connection with certain specific embodiments thereof, it is to be understood that this is by way of illustration and not of limitation, and the scope of the appended claims should be construed as broadly as the prior art will permit.

What is claimed is:

1. A laundry treating appliance configured to treat a laundry load according to a cycle of operation with a low level of treating liquid, the appliance comprising:

a drum at least partially defining a treating chamber and having an open top and a longitudinal axis; and an impeller mounted within the drum for reciprocal rotation about an axis generally coincident with the longitudinal axis of the drum and comprising:

a raised center;

a bottom plate located below the raised center and extending radially outward from the raised center and terminating in an outer periphery;

a transition region between the bottom plate and the raised center;

a center post extending upward from the raised center and having a height sufficient to prevent placement and migration of laundry items over the raised center; and a plurality of radial protrusions extending along the raised center, the bottom plate, and the transition region, each protrusion having an upper section projecting generally perpendicular from the raised center and the transition region, and a lower section projecting upward from the bottom plate, with the lower section increasing in width toward the outer periphery when viewed from above the bottom plate along the longitudinal axis of the drum;

wherein the center post, the protrusions and the bottom plate are configured such that during the cycle of operation, when the level of the treating liquid does not exceed the height of the bottom plate, the reciprocal rotation of the impeller generates a frictional interaction between the laundry items and the protrusions to drag the laundry in contact with the protrusions radially inward toward the raised center and induce an inverse toroidal movement of the laundry.

2. The laundry treating appliance of claim 1 wherein the center post and the raised center are generally cylindrical, and the center post has a smaller outer diameter than the raised center.

3. The laundry treating appliance of claim 1 wherein the impeller further comprises vanes on the center post.

4. The laundry treating appliance of claim 3 wherein the vanes extend radially outward from the center post and terminate at an outer edge, and the outer edge is straight.

5. The laundry treating appliance of claim 3 wherein the vanes extend radially outward from the center post and terminate at an outer edge, and the outer edge is curved.

6. The laundry treating appliance of claim 3 wherein at least some of the vanes are aligned with the protrusions.

7. The laundry treating appliance of claim 3 wherein the vanes extend to the raised center.

8. The laundry treating appliance of claim 7 wherein the center post has a constant diameter section, and the vanes extend along the entire height of the constant diameter section.

9. The laundry treating appliance of claim 1 wherein the center post terminates at an upper flared section.

10. The laundry treating appliance of claim 9 wherein the upper flared section holds a treating agent dispenser.

11. The laundry treating appliance of claim 1 wherein the impeller further comprises secondary protrusions provided only on the bottom plate between the protrusions.

12. The laundry treating appliance of claim 11 wherein one secondary protrusion is located between adjacent protrusions.

13. The laundry treating appliance of claim 11 wherein the secondary protrusions have a generally triangular configuration when viewed from above the bottom plate.

14. The laundry treating appliance of claim 11 wherein the secondary protrusions have side walls that terminate at a ridge and a front wall connecting the side walls and extending along the outer periphery.

15. The laundry treating appliance of claim 1 wherein the protrusions have a generally triangular configuration when viewed from above the bottom plate.

16. The laundry treating appliance of claim 1 wherein the protrusions have an upper surface, and the upper section has a shoulder such that the upper surface transitions from a generally horizontal to a generally vertical orientation at the shoulder.

17. The laundry treating appliance of claim 1 wherein the protrusions have an upper surface, and at the lower section, the upper surface is generally parallel to the bottom plate and curves down to form a front wall at the outer periphery.

18. The laundry treating appliance of claim 17 wherein the upper surface widens toward the outer periphery to form the front wall.

19. The laundry treating appliance of claim 1 wherein the raised center, the transition region, and the bottom plate have a combined height of about one-third of the impeller height.

20. The laundry treating appliance of claim 19 wherein the height of the center post is about two-thirds of the impeller height.

* * * * *